US008083026B1

(12) United States Patent
Butler

(10) Patent No.: US 8,083,026 B1
(45) Date of Patent: Dec. 27, 2011

(54) DIFFUSER MUFFLER

(76) Inventor: Boyd L. Butler, Sandy, UT (US)

( * ) Notice: Subject to any disclaimer, the term of this patent is extended or adjusted under 35 U.S.C. 154(b) by 0 days.

(21) Appl. No.: 12/795,543

(22) Filed: Jun. 7, 2010

(51) Int. Cl.
*F01N 1/08* (2006.01)

(52) U.S. Cl. ..... 181/264; 181/212; 181/228; 181/229; 181/240; 181/268

(58) Field of Classification Search ..... 181/268, 181/275, 264, 212, 228, 238, 239, 240
See application file for complete search history.

(56) References Cited

U.S. PATENT DOCUMENTS

| | | | | |
|---|---|---|---|---|
| 1,597,397 | A | 8/1926 | Wilkinson | |
| 1,922,848 | A * | 8/1933 | Harley | 181/264 |
| 3,958,950 | A | 5/1976 | DePalma | |
| 4,305,477 | A | 12/1981 | Moore | |
| 4,574,914 | A * | 3/1986 | Flugger | 181/268 |
| 5,123,501 | A | 6/1992 | Rothman et al. | |
| 5,123,502 | A * | 6/1992 | Flugger | 181/264 |
| 5,304,749 | A * | 4/1994 | Crandell | 181/264 |
| 5,371,331 | A * | 12/1994 | Wall | 181/227 |
| 5,444,197 | A | 8/1995 | Flugger | |
| 5,892,186 | A * | 4/1999 | Flugger | 181/252 |
| 5,925,857 | A * | 7/1999 | Birkel et al. | 181/250 |
| 5,936,210 | A | 8/1999 | Borneby et al. | |
| 6,089,347 | A * | 7/2000 | Flugger | 181/264 |
| 7,219,764 | B1 | 5/2007 | Forbes | |
| 7,380,635 | B2 * | 6/2008 | Harris | 181/206 |
| 2004/0134713 | A1 | 7/2004 | Khayalian | |

* cited by examiner

*Primary Examiner* — Forrest M Phillips
(74) *Attorney, Agent, or Firm* — Thorpe North & Western LLP

(57) ABSTRACT

A muffler for attenuating acoustic noise in a gas flow that includes a casing having a substantially-rectangular cross-section with an inlet opening in an inlet end and an outlet opening in an outlet end, so that a gas flow containing acoustic noise passes from the inlet opening to the outlet opening. The muffler also includes a V-shaped sound diffuser disposed within the casing and spanning the distance between opposing top and bottom walls of the casing. The sound diffuser comprises a pair of elongate leg plates having base ends attached to the outlet end on opposite sides of the outlet opening, and tip ends merged into an apex that is aligned with the inlet opening. Each leg plate has a plurality of apertures formed therein, and the apex splits the inlet gas flow into two side flows, with each side flow passing through the plurality of apertures in one of the leg plates to reach the outlet opening.

18 Claims, 5 Drawing Sheets

DIFFUSER MUFFLER

FIELD OF THE INVENTION

The field of the invention relates generally to systems and methods for attenuating acoustic noise in a gas flow, and more specifically to mufflers for reducing high-intensity noise produced by internal combustion engines, gas compressors, air blowers and various other vehicular and industrial applications, and their associated piping, etc.

BACKGROUND OF THE INVENTION AND RELATED ART

Prior art acoustic mufflers are generally of two types, friction-type mufflers which place rigid barriers such as baffle plates with apertures into the path of the gas flow to break up and mix the sound waves, and absorption-type mufflers which absorb the sound waves in an acoustic damping material.

The friction-type muffler is used most frequently, particularly on automobiles. This type of muffler typically has a casing with an inlet and outlet which can be positioned in a variety of locations, and a series of baffle plates there between to direct the gas flow in a circuitous route from inlet to outlet to cause mixing of the gas flow. Offset perforated inlet and outlet pipes may each extend the length of the casing to provide the circuitous route. Friction type mufflers are generally effective at reducing noise levels, but can also offer substantial resistance because of the circuitous route followed by the gas flow that is turned multiple times through the various apertures in the inlet and outlet pipes and/or the baffle plates. Therefore, significant pressure is required to force the gases through the muffler. This additional pressure, referred to as back pressure, reduces the efficiency and power output of the source device being muffled.

The typical absorption-type muffler has a casing with a pipe extending completely therethrough. A portion of the pipe inside the casing is perforated and the space between the pipe and casing is filled with sound absorbing fiberglass, ceramic fibers, or metallic wool mesh to absorb sound waves. By allowing the exhaust gases to pass directly through the muffler the velocity of the flow is increased while the back pressure required to push the gas through the muffler is significantly reduced in comparison with friction type mufflers, resulting in higher flow rates obtained from the source device. However, sound attenuation is often much less than that obtained with friction mufflers because of the reduced exposure to the absorption media, making this type of muffler unacceptable in many applications.

Muffler acoustic efficiency is measured in decibels of noise attenuation (dba) versus gas flow in cubic feet per minute (CFM). When a pressure difference of 5 inches of water is imposed between the inlet and outlet, and using a common 2½ inch diameter muffler inlet and outlet, friction type mufflers have about 10-18 dba attenuation and typically 70-160 CFM flow. Absorption type straight through mufflers under those conditions have an attenuation of about 2-7 dba and 200+CFM flow.

There is a need in many applications for a muffler which has greater acoustic attenuation than the absorption type muffler, but with higher flow rates and less back pressure than the friction type mufflers.

SUMMARY OF THE INVENTION

In accordance with one representative embodiment described herein, a muffler is provided for attenuating acoustic noise in a gas flow. The muffler includes a casing having a substantially-rectangular cross-section with an inlet opening in an inlet end and an outlet opening in an outlet end, so that a gas flow containing acoustic noise passes from the inlet opening to the outlet opening. The muffler also includes a V-shaped sound diffuser disposed within the casing and spanning the distance between opposing top and bottom walls of the casing. The sound diffuser comprises a pair of elongate leg plates having base ends attached to the outlet end on opposite sides of the outlet opening, and tip ends merged into an apex that is adjacent to and aligned with the inlet opening. Each leg plate has a plurality of apertures formed therein, and the apex splits the inlet gas flow into two side flows, with each side flow passing through the plurality of apertures in one of the leg plates to reach the outlet opening.

In accordance with another representative embodiment described herein, a muffler is provided for attenuating acoustic noise in a gas flow. The muffler includes an elongate flow tube having an interior cross-section surrounding a longitudinal axis, an inlet opening in an inlet end for receiving a fluid flow, and an outlet opening in an outlet end for discharging the fluid flow. The muffler also includes a peaked sound diffuser spanning the interior cross-section to separate the flow tube into an inlet chamber and an outlet chamber. The sound diffuser comprises a base portion attached to the outlet end and surrounding the outlet opening; an apex portion forming a pointed end aligned with the inlet opening, and a center portion between the base portion and the tip portion having a plurality of apertures formed therein. The apex portion splits an inlet gas flow into a plurality of side flows, with each side flow passing through the plurality of apertures from the gradually-shrinking inlet chamber to the gradually-expanding outlet-chamber, prior to exiting through the outlet opening In accordance with another representative embodiment described herein, a method is provided for attenuating acoustic noise in a gas flow. The method includes providing an inlet gas flow containing acoustic noise to a casing having an inlet opening in an inlet end and an outlet opening in an outlet end. The method also includes splitting the inlet gas flow into a plurality of side flows with an apex portion of a peaked sound diffuser, wherein the apex portion is aligned with the inlet opening. The method further includes passing the plurality of side flows through a plurality of apertures formed through at least one angled sidewall of the peaked sound diffuser that extends between the apex portion and a base portion of the sound diffuser, wherein the base portion is attached to the outlet end of the casing and surrounding the outlet opening, and merging the plurality of side flows behind the at least one angled sidewall prior to discharging an exit flow through the outlet opening.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best understood with reference to the accompanying drawings, wherein the elements and features of the embodiments are designated by numerals throughout.

Illustrated in FIGS. 1-9 are several representative embodiments of a diffuser muffler, which embodiments include one or more methods for attenuating acoustic noise in a gas flow contained with a piping or exhaust system. As described herein, the diffuser muffler provides several significant advantages and benefits over other devices and methods for attenuating acoustic noise in a gas flow. It is to be understood, however, the recited advantages are not meant to be limiting in any way, as one skilled in the art will appreciate that other advantages may also be realized upon practicing the present invention.

Figure 1:
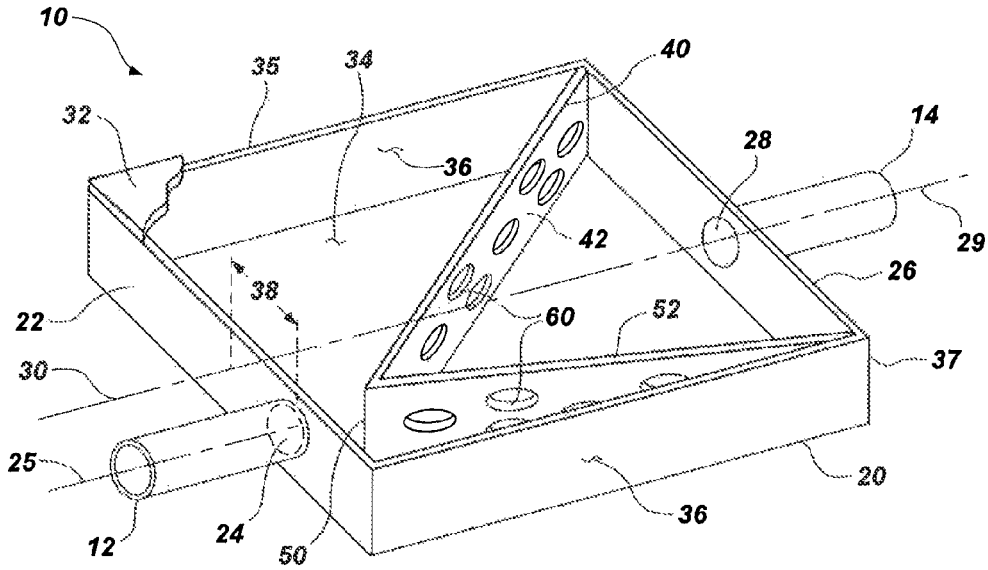
FIG. 1 is perspective, cut-away view of the diffuser muffler, in accordance with one representative embodiment.

FIG. 1 is a perspective, cut-away view of one representative embodiment of the diffuser muffler 10. The diffuser muffler 10 includes a casing 20 or flowtube having a substantially-rectangular cross-section, and with an inlet opening 24 in an inlet end 22 and an outlet opening 28 in an outlet end 26, so that a gas flow containing acoustic noise passes from the inlet opening 24, through the interior volume of the casing 20 and out through the outlet opening 28. In one aspect the casing 20 can be an elongate body having a centerline longitudinal axis 30 that is substantially parallel with the inlet pipe 12 that is connected to an inlet opening 24 and with an outlet pipe 14 that is connected to the outlet opening 28. The axis 25 of the inlet pipe 12/inlet opening 24 may or may not be co-axial with the axis 29 of the outlet opening 28/outlet pipe 14, or with the longitudinal axis 30 of the casing 20, and may be offset from by a distance 38 from the centerline longitudinal axis 30 (see FIG. 2) and/or from the axis 29 of the outlet opening 28/outlet pipe 14, in order to accommodate lateral displacements in the piping or exhaust system which carries and directs the gas flow containing acoustic noise.

Even though the casing 20 or flowtube is drawn in FIG. 1 with sharp, ninety-degree side edges 35 (at the seams connecting the sidewalls 36 with the top wall 32 and bottom wall 34) and corners 37 (at the seams connecting the sidewalls 36 with the inlet end panel 22 and the outlet end panel 28), it is to be appreciated other configurations are also possible, and that the side edges 35 and corners 37 may also be rounded or chamfered, etc., if so desired, and still fall within the definition of a substantially-rectangular cross-section as used herein. Moreover, the substantially-rectangular cross-section of the casing 20 may or may not be constant from the inlet end 22 to the outlet end 26, and may vary along the length of the longitudinal axis 30 to form an expanded, tapered or curved casing body if so desired.

The diffuser muffler 10 also includes a peaked sound diffuser 40 disposed within the casing 20 and spanning the distance between the opposing top 32 and bottom 34 walls of the casing. For the embodiment 10 having a substantially-rectangular cross-section, the peaked sounded diffuser 40 can include a pair of elongate leg plates 42, 52 (or angled sidewalls) assembled together to form a V-shape, with the base ends of the leg plates attached to the outlet side 26 of the casing on opposite sides of the outlet opening 28, and tip ends that join or merge together into an apex 50 that is aligned with the inlet opening 24, and which can be near or adjacent to the inlet opening. Each leg plate 42, 52 also has a plurality of apertures 60 formed therein.

The various components of the diffuser muffler can be made from metal or metal alloys capable of resisting a high temperature gas flow, such as hot exhaust gas from a vehicle engine. For example, in one aspect the casing 20, the peaked sound diffuser 40, and the inlet 12 and outlet 14 piping can all be made from a carbon steel that is heat resistant and amiable to welding or brazing and to the various cold working processes used with metallic sheets, such as bending and folding. However, other materials such as stainless steel, aluminum or other metallic alloys, ceramics, plastics and/or composites, etc., and the various alternative methods of making and assembly the same known to one of skill in the art, are also possible. As a wide variety of other industrial applications can also generate gas flows having acoustic noise entrained therein, the materials and methods of making the diffuser muffler can also be adapted to moderate and low-temperature (including cryogenic) applications.

Figure 2:
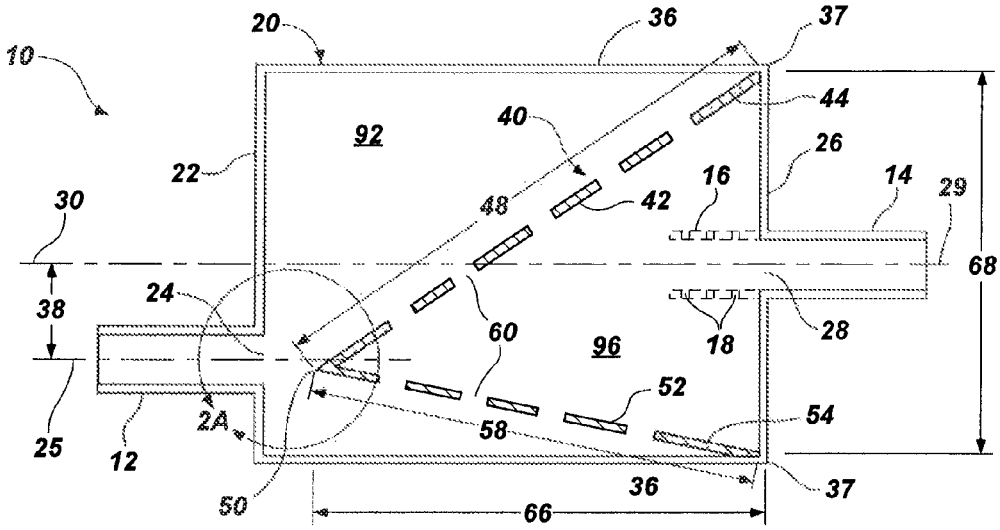
FIG. 2 is a top, sectional view of the diffuser muffler of FIG. 1.

As shown in FIG. 2, the peaked sound diffuser 40 operates to separate the flow tube or casing 20 into an inlet chamber 92 and an outlet chamber 96, and the edges or perimeters of the leg plates 42, 52 can seal against the inside surfaces of the casing so that all of the gas flow is directed through the apertures 60. Moreover, the V-shaped arrangement of the leg plates 42, 52 causes the cross-sectional area of the inlet chamber 92 upstream of the sound diffuser to gradually shrink, and the cross-sectional area of the outlet chamber 96 behind the sound diffuser to gradually expand, as the gas flow passes from the inlet end 22 to the outlet end 26 of the diffuser muffler. Thus, as the gas flow having acoustic noise enters the diffuser muffler 10 through the inlet opening 24, the apex 50 of the peaked sound diffuser 40 splits the inlet flow into two side flows, with each side flow being directed by the gradually-shrinking inlet chamber to pass through the apertures 60 in one of the leg plates 42, 52 and into the gradually-expanding outlet chamber, prior to exiting through the outlet opening 28.

In one aspect the base ends 44, 54 of the angled sidewalls or leg plates 42, 52 can be attached to the opposite sidewall corners 37 of the outlet end 26 of the flowtube or casing 20, where the outlet end joins with the two sidewalls 36. In this configuration the peaked sound diffuser 40 can span the substantially-rectangular, interior cross-section of the casing 20 from top-to-bottom and side-to-side. The peaked sound diffuser 40 can also span the interior cross-section of the casing 20 in other aspects or configurations (not shown), such as when the base ends 44, 54 of the leg plates 42, 52 are attached directly to the sidewalls 36 of the casing at a distance that is forwardly-removed from the outlet end 26. Moreover, the degree of sound attenuation provided by a diffuser muffler 10 of a particular size may be maximized when the base portion (e.g. the base ends of the leg plates) of the peaked sound diffuser 40 is attached to the outlet side or end 26 of the casing 20 and surrounding the outlet opening 28, thereby maximizing the lengths 48, 58 of the respective leg plates 42, 52 and allowing for the greatest separation or spacing between the apertures 60 formed therein.

It is to be understood, moreover, that the proportion of height, width and length of the angled leg plates 42, 52 and their relation to the dimensions of the case 20 are in no way restricted to the illustrated embodiments presented herein. For example, the height of the leg plates 42, 52 may be much greater with respect to the length 48, 58 of the leg plates, if so desired, and with a corresponding increase in the length of the corners 37 with respect to the length of the side edges 35, so as to create a diffuser muffler case 20 having a more-boxy shape and profile.

It is also to be appreciated that the diffuser muffler 10 described herein, and which embodiments include the peaked sound diffuser 40, may be configured and optimized to provide enhanced sound attenuation at higher flow rates and with less back pressure loss than the typical friction-type devices presently used to attenuate acoustic noise in a gas flow. For example, the number, size, spacing and shape of the apertures 60 relative to the solid portions of the leg plates 42, 52 can be configured to maximize the sound attenuation that takes place during a single passage of the gas flow through the apertures, from the inlet chamber 92 to the outlet chamber 96, rather than passing multiple times through various holes in the plurality of baffle plates and/or perforated pipes in the more traditional friction-type devices. In addition, the shallow angle of the leg plates 42, 52 relative to the longitudinal axis 30 of the flowtube or casing 20 can also be optimized to create an indeterminate acoustic reflector effect, in which sound waves entering the diffuser muffler 10 through the inlet opening 24 cannot find purchase for a complete reflection, and instead are broken up, diffused, and/or absorbed through the apertures 60 in the sides plate 42, 52 or partially reflected forward into the decreasing wedges of the inlet chamber 92 for entrapment and further dissipation. Thus, the peaked sound diffuser 40 enclosed within the flow-tube or casing 20 can be configured to break up and attenuate or absorb sound waves traveling through the piping or exhaust system in a more efficient manner than simple friction-type mufflers.

In one aspect, for instance, the peaked sound diffuser 40 can be configured with a length 66 that is about one and a half or more times the width 68 of the base ends of the V-shaped structure, so that each of the angled side plate 42, 52 can be orientated at a shallow angle of less than or about twenty degrees relative to the longitudinal axis 30 of the flowtube or casing 20.

Figure 4:
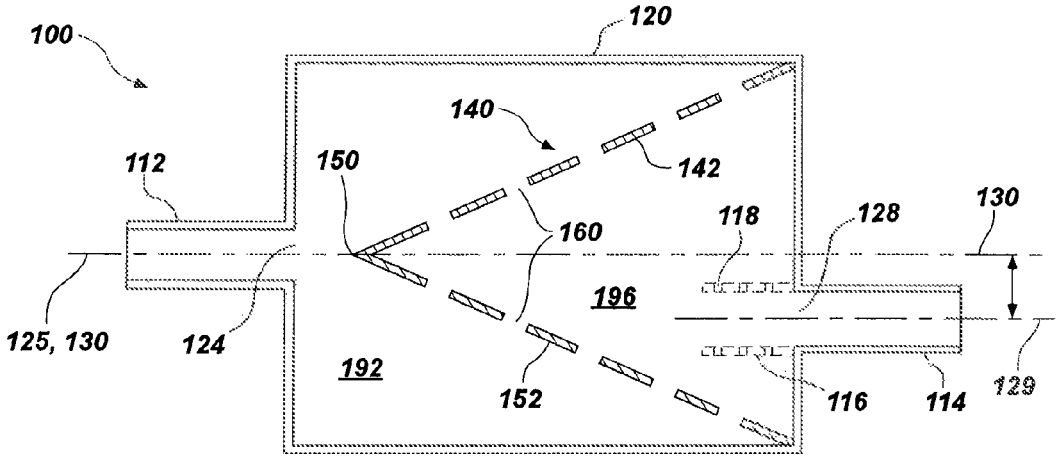
FIG. 4 is a top, sectional view of the diffuser muffler, in accordance with one representative embodiment.

Also illustrated in FIG. 2 is the lateral offset or distance 38 between the axis 25 of the inlet opening 24/inlet pipe 12 and the axis 29 of the outlet opening 28/outlet pipe 14, which may often be found in piping or exhaust systems that have been routed to avoid obstacles and other equipment. To accommodate the lateral displacement in the piping, the center axis 25 of the inlet opening/inlet pipe may be offset a distance 38 from the longitudinal axis 30 of the casing (and the center axis 29 of the outlet opening/outlet pipe), as shown in FIGS. 1-2. Alternatively, as shown in FIG. 4, the outlet opening 128/outlet pipe 114 may offset from the longitudinal axis 130 of the casing. In yet another aspect (not shown) both the inlet opening/inlet pipe and outlet opening/outlet pipe can be offset of the longitudinal axis of the casing. Thus, the diffuser muffler can be used as a routing component in the piping or exhaust system as well as an acoustic noise attenuating component, since the diffuser muffler can provide consistent sound attenuation performance regardless of the lateral locations of the inlet opening and/or outlet opening relative to each other and to the longitudinal axis of the casing.

In configurations where the centerline axis 25 of the inlet pipe 12 and inlet opening 24 is offset laterally from the longitudinal axis 30, as illustrated in FIG. 2, the length of the leg plates 42, 52 can be adjusted so that the apex 50 of the peaked diffuser 40 is aligned with the inlet opening, and splits the inlet flow into two side flows which pass into the inlet chambers 92 on either side of the peaked diffuser 40. Each side flow will then move through the plurality of apertures 60 in the nearest leg plate and into the outlet chamber 96. Since the lengths of the leg plates are unequal, with the length 48 of leg plate 42 being longer than the length 58 of leg plate 52, the lateral position of the apex can be configured to split the inlet gas flow into two unequal side flows that are proportional in flow rate to the length (and surface areas) of the two leg plates, with the greater of the two side flows passing into that portion of the inlet chamber 92 that is bounded by the longer leg plate 42. Moreover, the summation of the areas of all the apertures 60 in the longer leg plate 42, or the combined aperture area, can also be proportionately greater than the combined aperture area of the shorter leg plate 52. Consequently, the total aperture area of the peak diffuser can be proportionately split between the two leg plates in accordance with the division of flow rates into the inlet chambers on either side of the V-shaped diffuser structure 40. This can operate to equalize the pressure drop across the apertures of both leg plates.

Figure 2A:
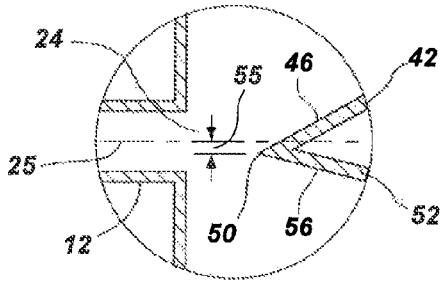
FIGS. 2A-2B are close-up, sectional views of the inlet opening and apex region of the diffuser muffler of FIG. 2, in accordance in various representative embodiments.
Figure 2B:
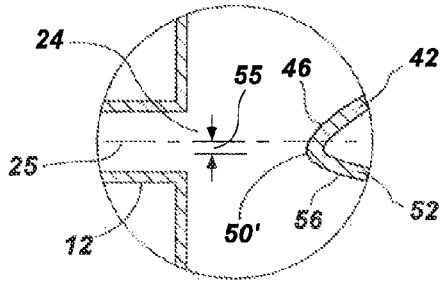

As illustrated in the close-up views of FIGS. 2A and 2B, the tip end 46 of leg plate 42 and the tip end 56 of leg plate 52 can be joined together to form an apex 50 of the peaked sound diffuser that is substantially aligned and adjacent to the inlet opening 24, but which is also slightly offset in a lateral direction from the center axis 25 of the inlet opening 24/inlet pipe 12 by an apex offset distance 55. Consequently, the apex offset distance 55 can be used to split the inlet flow into the two unequal side flows described above. Because the inlet opening can be round and the apex of the peaked diffuser can be a vertically-aligned edge that crosses in front of the round opening (see FIG. 1), the degree of splitting of the inlet gas flow can be very sensitive to the lateral position of the apex, and even a slight variation in the apex offset distance 55 can result in a significant variation in the flow rates of the two side flows. In one aspect the apex 50 of the peaked sound can be substantially pointed, as shown in FIG. 2A. In another aspect the apex 50' can also be rounded with a small radius, as shown in FIG. 2B, as would likely be the case with the peaked sound diffuser being made from a single piece of bar stock that is folded to form the apex 50' and two leg legs plates 42, 52.

Referring back to FIG. 2, in one aspect the outlet pipe 14 can be extended through the outlet opening 28 and into the outlet chamber 96 inside the casing 20 to form an outlet stub 16. The cylindrical sidewalls of the outlet stub can also have apertures 18 or perforations formed therein which can operate to better direct and channel the exiting gas flow out through the outlet opening 28 and into the outlet pipe 14.

The diffuser muffler's 10 ability to break up and attenuate sound waves traveling through the piping system can be due, at least in part, to the indeterminate reflector surfaces provided by the angled leg plates 42, 52 of the peaked sound diffuser, as described above. Thus, the sound attenuation provided by the diffuser muffler can be accomplished with reduced pressure or head loss in comparison to other noise attenuators or mufflers that rely primarily on friction or energy loss dissipation to reduce the noise levels as the gas flow transitions through multiple apertures or orifices in multiple baffle plates. It can be desirable, therefore, to maintain the total or combined area of the apertures 60 in the peaked sound diffuser to be substantially equal to or greater than the area of the inlet opening 24, so that there is a minimal pressure loss as the gas flow passes through the apertures.

In addition to the indeterminate acoustic reflector effect created by the shallow angle of the leg plates 42, 52 relative to the longitudinal axis 30 of the casing 20, the size, number, shape and arrangement of the apertures 60 can also have a large affect on the sound attenuation performance of the diffuser muffler 10. Added sound attenuation can be provided, for instance, with a large number of small apertures having a size that is only a fraction of the primary wavelengths of the sound vibrations entering the diffuser muffler, and which are arranged over the surfaces of the leg plates so that the solid portions between the apertures continue to reflect the sound energy back and away from the peaked diffuser even as the gas flow passes through the apertures. In one aspect the total combined area of the apertures 60 can be two to ten times greater than the area of the inlet opening 24 so as to minimize the pressure loss. In another aspect the edges of the apertures 60 can be modified, such as being rounded, smoothed or curved, to further reduce any friction as the gas flow passes through the leg plates from the inlet chamber 92 to the outlet chamber 96.

Figure 3A:
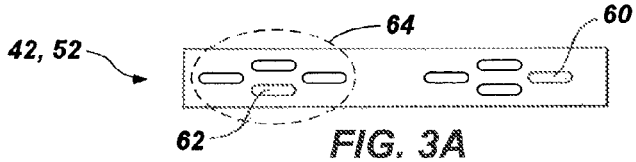
FIGS. 3A-3F together illustrate representative embodiments of the apertures formed into the elongate leg plates of the diffuser muffler of FIG. 1.
Figure 3B:
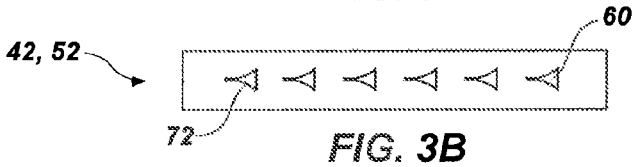
Figure 3C:
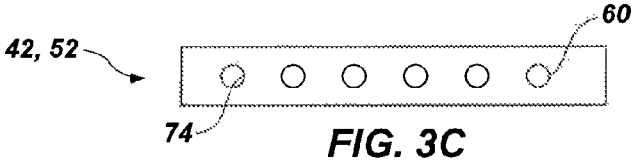
Figure 3D:
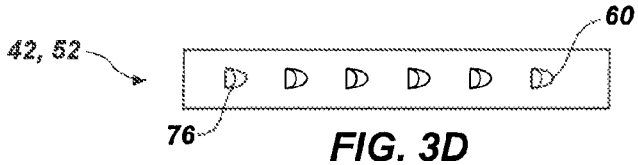
Figure 3E:
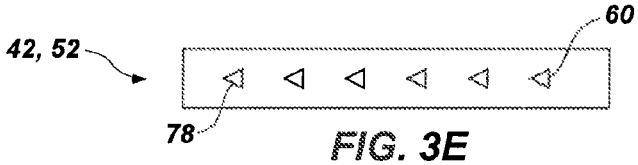
Figure 3F:
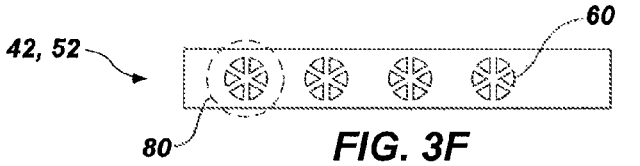

FIGS. 3A-3F together illustrate representative embodiments of the apertures 60 which may be formed into the elongate leg plates 42, 52 of the peaked sound diffuser 40 disposed within the diffuser muffler of FIGS. 1 and 2. In one aspect, as shown in FIG. 3A, obround apertures 62 can be grouped into clusters 64 that are located closer to one end or both ends of the leg plates 42, 52. In other aspects the apertures can be NACA duct openings 72, round openings 74, louvered openings 76, or polygonal openings having a triangular 78, square, rectangular or diamond shapes, etc., and can be equally spaced along the length of the leg plates, as illustrated in FIGS. 3B-3E. Other aperture shapes may include, but are not limited to, pie, slotted, elliptical and semi-circular shapes etc., and can be positioned in any location along the face of the leg plates 42, 52. Moreover, the apertures 60 can also comprise individual complex shapes or group patterns, such has the honeycomb-shaped aperture group 80 shown in FIG. 3F.

Illustrated in FIG. 4 is another representative embodiment of the diffuser muffler 100 in which the axis 125 of the inlet opening 124/inlet pipe 112 is aligned with the longitudinal axis 130 of the casing 120, but the axis 129 of the outlet opening 128/outlet pipe 114 is laterally offset from the casing's longitudinal axis. In this configuration the length of the leg plates 142, 152 (or angled sidewalls) of the peaked diffuser 140 can be equal, and the apex 150 can be substantially aligned and adjacent to the inlet opening 124, and can also aligned with the center axis 125 of the inlet opening/inlet pipe so as to split the inlet gas flow into two equal side flows. Moreover, the total aperture area of the peak diffuser 140 can be equally split between the two leg plates to equalize the pressure drop across the apertures 160 of both leg plates 142, 152.

Having the outlet opening 128 closer to one leg plate 152 than the other leg plate 142 can have a minimal affect of the performance of the diffuser muffler 100, since the majority of the sound attenuation can take place at the indeterminate reflector surfaces provided by the angled leg plates 142, 152 of the peaked sound diffuser 140 and as the side flows are broken up to pass through the plurality of apertures 160. Thus, in one aspect most of the sound attenuation can be accomplished by the time the gas flow reaches the outlet chamber 196 located behind (or downstream of) the peaked diffuser, and the plurality of gas flows entering the outlet chamber 196 through the plurality of apertures 160 can be free to take separate paths as they merge together into an exit flow prior to being discharged from the casing 120 through the outlet opening 128.

Also shown in FIG. 4 is an alternative aspect of the diffuser muffler 100 that includes the outlet pipe 114 extending through the outlet opening 128 and into the outlet chamber 196 to form a stub 116. As described above, the cylindrical sidewalls of the outlet stub may also have apertures 118 or perforations formed therein which can operate to better direct and channel the exiting gas flows out through the outlet opening 128 and into the outlet pipe 114.

Figure 5:
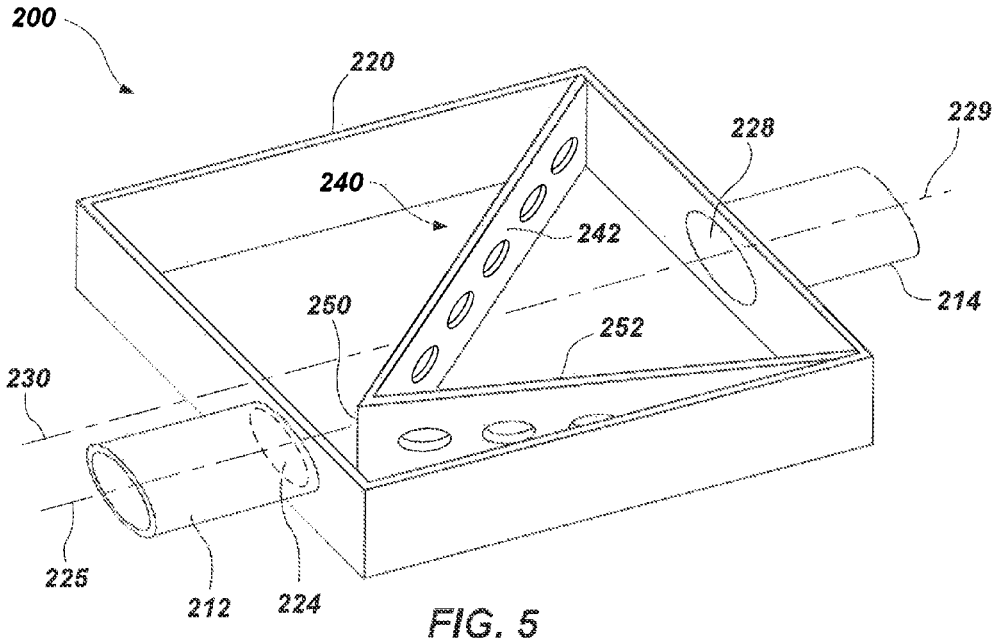
FIG. 5 is perspective, cut-away view of the diffuser muffler, in accordance with yet another representative embodiment.

In accordance with yet another representative embodiment, FIG. 5 is perspective, cut-away view of a diffuser muffler 200 having non-circular inlet pipes 212 and outlet pipes 214 which direct the gas flow containing acoustic noise into casing 220 through the non-circular inlet opening 224 and withdraw the gas flow out through the non-circular outlet opening 228, respectively. As shown, the non-circular pipes and openings can be oval, oblong or obround, etc., and can allow for greater tolerances when aligning the apex 250 of the peaked sound diffuser 240 with the center axis 225 of the inlet opening 224/inlet pipe 212 to split the inlet gas flow into the unequal side flows that are proportional in flow rate to the length (and surface areas) of the two leg plates 242, 252.

Figure 6:
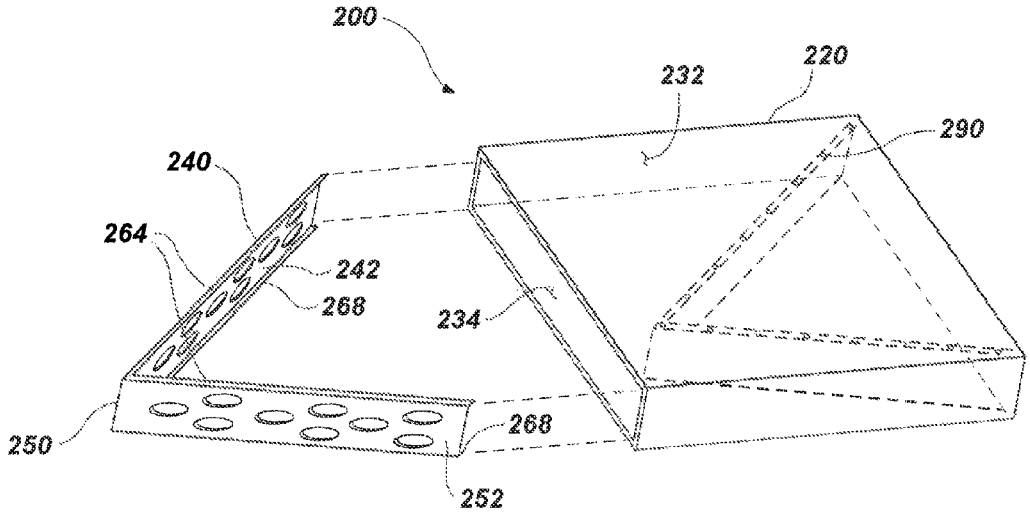
FIG. 6 is an exploded assembly of the diffuser muffler, in accordance with yet another representative embodiment.

A partial assembly view is shown in FIG. 6 and illustrates one exemplary method of the making the diffuser muffler 200. For instance, in one aspect the peaked sound diffuser 240 can comprise a single metal piece that is folded at the apex 250 to form the V-shaped peaked diffuser with two leg plates 242, 252. In another aspect the peaked sound diffuser can comprise two plates that are welded, bolted or otherwise attached together at one end to form the apex. If necessary, a small, angled support bracket (not shown) can be placed at the tip, either in front of or behind of the joint, to provide an attachment surface and additional support. The leg plates 242, 252 themselves can also be configured with folded top 264 and bottom 268 edges that are bent substantially perpendicular to the vertical plane of the leg plate, and which can contact the top wall 232 and bottom wall 234 when the peaked sound diffuser 240 is inserted into the casing 220 or flow tube. Additionally, periodically-spaced plug welds 290 which penetrate the top 232 and bottom 234 walls to weld with the folded edges can then be made along the length of the leg plates. Other methods of mounting or fastening the peaked sound diffuser into the casing have also been contemplated, including but not limited to seam welding, brazing, rivets, screws, bolting, and adhesives, etc., and each of which may be considered to fall within the scope of the present invention.

Figure 7:
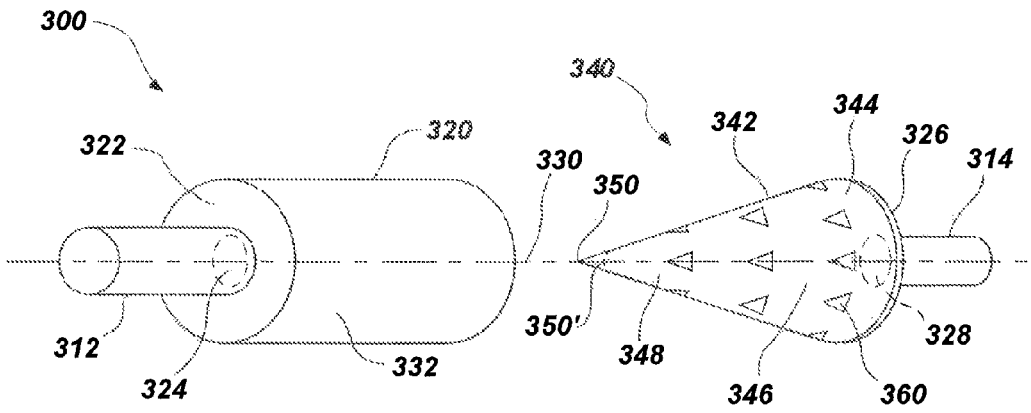
FIG. 7 is an exploded assembly of the diffuser muffler, in accordance with yet another representative embodiment.
Figure 8:
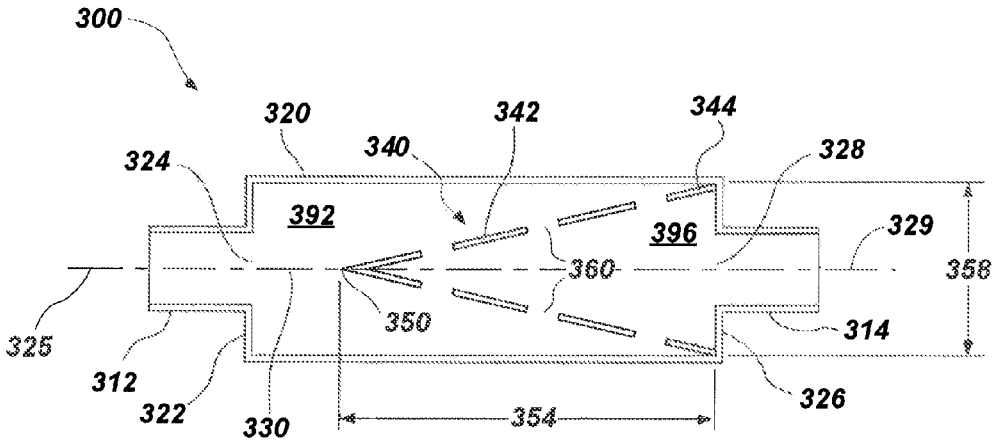
FIG. 8 is a top, sectional view of the diffuser muffler of FIG. 7.

FIGS. 7-8 together illustrate yet another representative embodiment 300 of the diffuser muffler having a flowtube or casing 320 with a peaked sound diffuser 340 disposed therein. As can be seen, the casing 320 can be a rounded cylinder having an inlet opening 324 formed into an inlet end 322 and an outlet opening 328 formed into an outlet end 326, and with the inlet and outlet openings being coupled to inlet 312 and outlet 314 pipes, respectively. In one aspect the center axis 325 of the inlet opening 324/inlet pipe 312 can concentric with both the longitudinal center axis 330 of the casing 320, and with the center axis 329 of the outlet opening 328/outlet pipe 314. Other aspects in which either the inlet opening/inlet pipe or the outlet opening/outlet pipe, or both, are offset or shifted from longitudinal center axis of the casing are also possible, however, and can be considered to fall within the scope of the present invention.

The peaked diffuser 340 can comprise a rounded sidewall 342 formed into a conical or tapered shape, with a base portion 344 attached to the outlet end 326 (or the cylindrical sidewalls 332 of the casing 320) and surrounding the outlet opening 328, and a tip portion 348 forming a pointed end or apex 350 aligned with the inlet opening 324. In one aspect the apex 350' can also be rounded. The angled sidewall of the peaked sound diffuser can operate to divide the interior volume of the casing into an inlet chamber 392 and an outlet chamber 396. A center portion 346 of the angled sidewall 342 between the base portion 344 and the tip portion 348 can have a plurality of apertures 360 formed therein to allow the gas flow entering the diffuser muffler 300 to pass from the inlet chamber to the outlet chamber. Furthermore, bottom edges of the peaked sound diffuser 340 can seal against the inside surfaces of the casing 320, either against the outlet end 326 or the cylindrical sidewalls 332, so that all of the gas flow is directed through the apertures 360.

As can be seen, the conical or angled sidewall 342 can cause the annular cross-sectional area of the inlet chamber 392 upstream of the sound diffuser 340 to gradually shrink, and the circular cross-sectional area of the outlet chamber 396 behind the sound diffuser to gradually expand, as the gas flow passes from the inlet end 322 to the outlet end 326 of the diffuser muffler. Furthermore, the tip portion 348 can split the inlet gas flow into a plurality of side flows, with each side flow passing through the plurality of apertures 360 from the gradually-shrinking inlet chamber 392 to the gradually-expanding outlet-chamber 396, prior to exiting through the outlet opening.

In one aspect the peaked sound diffuser can be configured with a length 354 that is about one and a half or more times the diameter 358 of the base portion 344 of the conical structure, so that the angled sidewalls can have a shallow angle of less than or about twenty degrees relative to the longitudinal axis 330 of the flowtube or casing 320. In this configuration the angled sidewalls can provide an indeterminate acoustic reflector effect, in which sound waves entering the diffuser muffler 300 through the inlet opening 324 cannot find purchase for a complete reflection, and instead are broken up, diffused, and/or absorbed through the apertures 360 in the angled sidewall or partially reflected forward into the decreasing wedge of the inlet chamber 392 for entrapment and further dissipation. Thus, the peaked sound diffuser 340 enclosed within the flow-tube or casing 320 can be configured to break up and attenuate or absorb sound waves traveling through the piping or exhaust system more efficiently than simple friction-type mufflers.

The size, number, shape and arrangement of the apertures 360 can also have a large affect on the sound attenuation aspects of the diffuser muffler, however. Added sound attenuation can be provided, for instance, with a large number of small apertures having a size that is only a fraction of the primary wavelengths of the sound vibrations entering the diffuser muffler, and which are arranged over the surfaces of the leg plates so that the solid portions between the apertures continue to reflect the sound energy back and away from the peaked diffuser even as the gas flow passes through the apertures. In one aspect the total combined area of the apertures 360 can be two to ten times greater than the area of the inlet opening 324 so as to minimize the pressure loss. In another aspect the edges of the apertures 360 can be modified, such as being rounded, smoothed or curved, to further reduce any friction as the gas flow passes through the leg plates from the inlet chamber 392 to the outlet chamber 396.

As described above, the shape of the apertures 360 can include, but is not limited to, obround, round, polygonal, pie, slotted, elliptical, semi-circular, louvered, NACA duct and other complex shapes or group patterns, etc., and combinations thereof.

If the center axis 325 of the inlet opening 324/inlet pipe 312 is offset or shifted from the longitudinal center axis 330 of the casing 320, the apex 350 of the conical peak diffuser 340 can also be offset by a substantially-similar amount (not shown) and aligned with the inlet opening 324 while the base portion 344 remains attached to the outlet end 326 (or the cylindrical sidewalls 332) and surrounding the outlet opening 328. In one aspect the apex 350 of the peaked diffuser 340 can also be slightly offset in a lateral direction from the center axis 325 of the inlet opening 24/inlet pipe 12 by an apex offset distance (also not shown), to split the inlet gas flow into a plurality of unequal side flows proportional to the various lengths of the angled sidewall 342. However, the three-dimensional nature of the peaked sound diffuser 340 and the plurality of unequal side flows within the cylindrical diffuser muffler embodiment 330 can operate to self-equalize the pressure drops across the plurality of apertures 360 positioned around the circumference and along the length of the peaked diffuser 340, and in a manner which may not be accomplished with the embodiment described above having a substantially two-dimensional V-shaped peaked diffuser.

Figure 9:
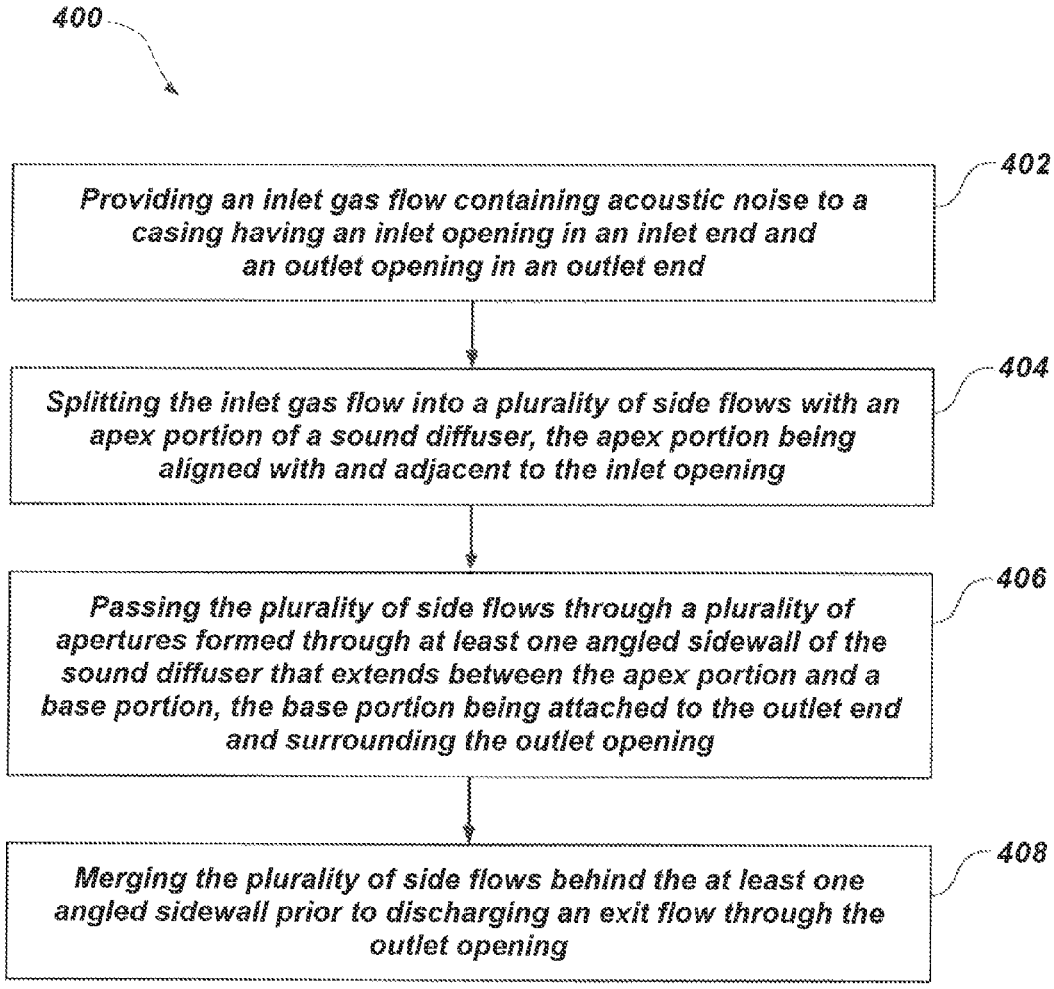
FIG. 9 is a flowchart depicting a method for attenuating acoustic noise in a gas flow, in accordance with yet another representative embodiment.

Illustrated in FIG. 9 is a flowchart depicting a method 400 for attenuating acoustic noise in a gas flow, in accordance with yet another representative embodiment. The method 400 includes the step of providing 402 an inlet gas flow containing acoustic noise to a casing having an inlet opening in an inlet end and an outlet opening in an outlet end. The method also includes the step of splitting 404 the inlet gas flow into a plurality of side flows with an apex portion of a peaked sound diffuser, wherein the apex portion is aligned with the inlet opening. The method further includes the steps of passing 406 the plurality of side flows through a plurality of apertures formed through at least one angled sidewall of the peaked sound diffuser that extends between the apex portion and a base portion of the sound diffuser, wherein the base portion is attached to the outlet end of the casing and surrounding the outlet opening, and merging 408 the plurality of side flows behind the at least one angled sidewall prior to discharging an exit flow through the outlet opening.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

1. A muffler for attenuating acoustic noise in a gas flow, comprising:

a casing having a substantially-rectangular cross-section with an inlet opening in an inlet end and an outlet opening in an outlet end, wherein a gas flow containing acoustic noise passes from the inlet opening to the outlet opening; and a V-shaped sound diffuser disposed within the casing and spanning a distance between opposing top and bottom walls of the casing, the sound diffuser comprising: a pair of elongate leg plates having base ends attached to the outlet end on opposite sides of the outlet opening and tip ends merged into an imperforate apex aligned with the inlet opening, each leg plate having a plurality of apertures formed therein, and wherein the imperforate apex splits an inlet gas flow into two side flows, with each side flow passing through the plurality of apertures in one of the leg plates to reach the outlet opening.

2. The muffler of claim 1, wherein a cross-sectional area of the casing is substantially constant from the inlet end to the outlet end.

3. The muffler of claim 1, wherein the base ends of the leg plates are attached to opposite sidewall corners of the outlet end.

4. The muffler of claim 1, wherein the inlet opening is centered about a vertical centerline of the inlet end.

5. The muffler of claim 1, wherein the inlet opening is offset from a vertical centerline of the inlet end.

6. The muffler of claim 5, wherein the leg plates are of unequal length.

7. The muffler of claim 6, wherein the apex of the sound diffuser splits the inlet gas flow into two unequal flow streams that are substantially proportional to the unequal lengths of the respective leg plates.

8. The muffler of claim 7, wherein a combined thru-hole area of the plurality of apertures formed into each leg plate is substantially proportional to the unequal lengths of the respective leg plates.

9. The muffler of claim 1, wherein the apertures further comprises obround slots, each having a long axis aligned with a longitudinal axis of its respective leg plate.

10. The muffler of claim 1, wherein a shape of the apertures is selected from the group consisting of a NACA-duct shape, a triangular shape, a pie shape, a square shape, a rectangular shape, a diamond shape, a polygonal shape, a round shape, a slotted shape, an oblong shape, an obround shape, an elliptical shape, a semi-circular shape, a louver shape, a honeycomb shape, and combinations thereof.

11. The muffler of claim 1, further comprising a tubular outlet stub extending inwardly from the outlet opening in the outlet end.

12. The muffler of claim 11, wherein the tubular outlet stub has a plurality of apertures formed therein.

13. A muffler for attenuating acoustic noise in a gas flow, comprising:

An elongate flow tube having an interior cross-section surrounding a longitudinal axis, an inlet opening in an inlet end for receiving the gas flow, and an outlet opening in an outlet end for discharging the gas flow; and A peaked sound diffuser spanning the interior cross-section to separate the flow tube into a gradually-shrinking inlet chamber and a gradually-expanding outlet chamber, the sound diffuser comprising:

A base portion attached to the outlet end surrounding the outlet opening:

An imperforate tip portion spaced a length from the base portion forming a pointed end aligned with the inlet opening; and A center portion extending the length between the base portion and the tip portion having a plurality of apertures formed therein along the length of the center portion;

Wherein the tip portion splits an inlet gas flow into a plurality of side flows, each passing through the plurality of apertures from the gradually-shrinking inlet chamber to the gradually-expanding outlet chamber, prior to exiting through the outlet opening.

14. The muffler of claim 13, wherein the flow tube has a circular cross-section and the sound diffuser comprises a substantially cone-shaped body.

15. The muffler of claim 13, wherein the flow tube has a rectangular cross-section and the sound diffuser comprises a substantially V-shaped body having a pair of elongate leg plates spanning a distance between opposing top and bottom walls of the flow tube.

16. A method for attenuating acoustic noise in a gas flow comprising:

providing an inlet gas flow containing acoustic noise to a casing having an inlet opening in an inlet end and an outlet opening in an outlet end; splitting the inlet gas flow into a plurality of side flows with an imperforate apex portion of a peaked sound diffuser, the apex portion being aligned with the inlet opening; passing the plurality of side flows through a plurality of apertures formed through and along at least one angled sidewall of the peaked sound diffuser that extends between the apex portion and a base portion of the sound diffuser, the base portion being attached to the outlet end of the casing and surrounding the outlet opening; and merging the plurality of side flows behind the at least one angled sidewall prior to discharging an exit flow through the outlet opening.

17. The method of claim 16, wherein the casing has a circular cross-section and the at least one angled sidewall comprises a cone-shaped body separating an interior volume of the casing into an inlet chamber and an outlet chamber.

18. The method of claim 16, wherein the casing has a rectangular cross-section and the at least one angled sidewall comprises a substantially V-shaped body having a pair of elongate leg plates spanning a distance between opposing top and bottom walls of the flow tube and separating an interior volume of the casing into an inlet chamber and an outlet chamber.

* * * * *